US008875896B2

(12) United States Patent
Mor-Yosef et al.

(10) Patent No.: US 8,875,896 B2
(45) Date of Patent: Nov. 4, 2014

(54) INSTALLATION GUIDE

(75) Inventors: Avichay Mor-Yosef, Jerusalem (IL); Elad Taig, Ramat Gan (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 479 days.

(21) Appl. No.: 13/145,552

(22) PCT Filed: Jan. 20, 2009

(86) PCT No.: PCT/US2009/031434

§ 371 (c)(1),
(2), (4) Date: Jul. 20, 2011

(87) PCT Pub. No.: WO2010/085238

PCT Pub. Date: Jul. 29, 2010

(65) Prior Publication Data

US 2011/0277317 A1 Nov. 17, 2011

(51) Int. Cl.

| | |
|---|---|
| ***B07C 5/02*** | (2006.01) |
| ***G03G 15/00*** | (2006.01) |
| ***G03G 15/10*** | (2006.01) |

(52) U.S. Cl.

CPC ..... *G03G 15/10* (2013.01); *G03G 15/75* (2013.01)

USPC ..... 209/3.1; 209/552; 209/700; 101/415.1; 101/477; 29/700; 242/336

(58) Field of Classification Search

USPC ..... 209/552, 700

See application file for complete search history.

(56) References Cited

U.S. PATENT DOCUMENTS

| | | | | |
|---|---|---|---|---|
| 4,767,079 | A * | 8/1988 | Saito et al. | 242/336 |
| 5,211,112 | A * | 5/1993 | Tsushima et al. | 101/415.1 |
| 5,868,072 | A * | 2/1999 | Nishi | 101/415.1 |
| 6,321,653 | B1 | 11/2001 | Kobayashi et al. | |
| 2008/0022876 | A1 * | 1/2008 | Yokoyama et al. | 101/477 |
| 2011/0277317 | A1 * | 11/2011 | Mor-Yosef et al. | 29/700 |

OTHER PUBLICATIONS

PCT International Search Report and Written Opinion in corresponding PCT patent application PCT/US2009/031434, dated Jul. 30, 2009.

* cited by examiner

*Primary Examiner* — Terrell Matthews

(57) ABSTRACT

In one embodiment, a guide for installing a photoconductive film on to a photo imaging plate includes a movable channel located near the photo imaging plate, for example in a digital printing press. The channel has a bed and a pair of sidewalls extending parallel to one another along opposite sides of the bed such that the lateral movement and skew of a photoconductive film lying on the bed is constrained by the sidewalls. The channel movable between a first position in which an open end of the channel is away from the photo imaging plate and a second position in which the open end of the channel is immediately adjacent to and aligned with the photo imaging plate for installing a photoconductive film on to the photo imaging plate.

4 Claims, 14 Drawing Sheets

INSTALLATION GUIDE

BACKGROUND

Liquid electro-photographic (LEP) printing, sometimes also referred to as liquid electrostatic printing, uses liquid toner to form images on paper or other print media. LEP is often used for large scale commercial printing. The basic LEP printing process involves placing a uniform electrostatic charge on a photoconductor, the photoconductive surface on a rotating drum for example, and exposing the photoconductor to light in the pattern of the desired printed image to dissipate the charge on the areas of the photoconductor exposed to the light. The resulting latent electrostatic image on the photoconductor is developed by applying a thin layer of liquid toner to the photoconductor. Liquid toner generally consists of charged toner particles dispersed in a carrier liquid. The charged toner particles adhere to the discharged areas on the photoconductor (discharged area development DAD) or to the charged areas (charged area development CAD), depending on the charge of the toner particles, to form the desired toner image on the photoconductor. The toner image is transferred from the photoconductor to an intermediate transfer member and then from the intermediate transfer member to the paper or other print medium.

In some LEP printers, the photoconductive element includes a replaceable film of photoconductive material wrapped around a rotating drum. This drum is commonly referred to as the PIP (Photo Imaging Plate) and the thin film of conductive material as the PIP foil. The PIP foil is replaced periodically, once or twice a work shift for example depending on the printing volume, to maintain the good print quality. A new PIP foil must be accurately aligned to the PIP drum during installation to help ensure good print quality and to minimize the risk of damaging the PIP foil during installation and printing.

DRAWINGS

For convenience, similar components may be designated by the same part numbers in the figures.

DESCRIPTION

Embodiments of the disclosure were developed to help a printer technician more consistently and more easily align the PIP foil to the PIP drum when installing a new PIP foil. While specific embodiments are described with reference to installing a PIP foil on a cylindrical PIP drum in an LEP printer, it may be possible to implement embodiments for aligning other thin, flexible sheets to other surfaces. Hence, the following description should not be construed to limit the scope of the disclosure.

Figure 1:
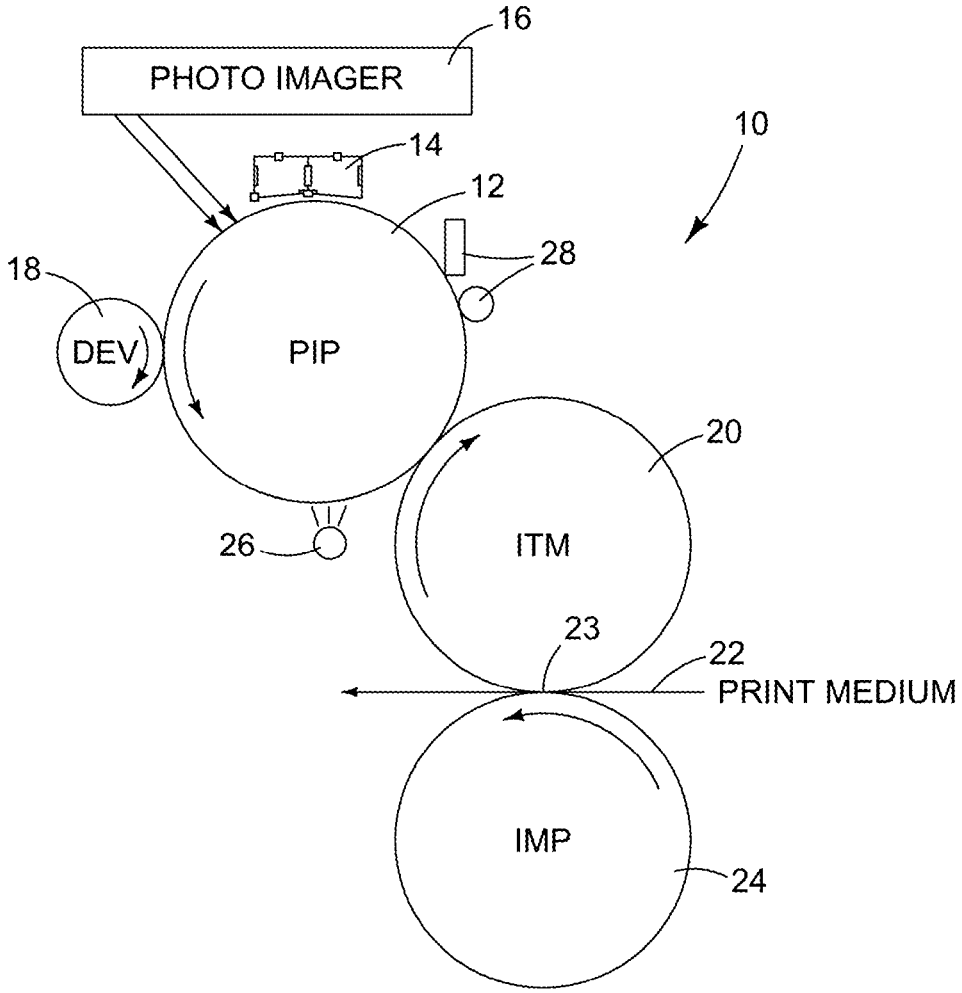
FIG. 1 is a block diagram illustrating the basic components an LEP print engine.

FIG. 1 is a block diagram illustrating the basic components of an LEP print engine 10. Referring to FIG. 1, in print engine 10 a uniform electrostatic charge is applied to a photoconductive element 12, a thin film of photoconductive material wrapped around the outer surface of a drum for example, by a scorotron, charge roller, or other suitable charging device 14. PIP 12 used for LEP printing is commonly referred to as a photo imaging plate (PIP). A scanning laser or other suitable photo imaging device 16 exposes selected areas on PIP 12 to light in the pattern of the desired printed image to dissipate the charge on the areas of PIP 12 exposed to the light. In discharge area development (DAD), for example, the discharged areas on PIP 12 form an electrostatic image which corresponds to the image to be printed. This electrostatic image is said to be a "latent" image because it has not yet been developed into a toner image. A thin layer of liquid toner is applied to the patterned PIP 12 using a developer roller 18. Developer roller 18 represents generally a typically complex developer unit, commonly referred to as a binary ink developer (BID), that supplies ink to a small roller that rotates against PIP 12. Hence, the developer unit is depicted generally in FIG. 1 by a developer roller 18.

The latent image on PIP 12 is developed through the application of the liquid toner which adheres to the discharged areas of PIP 12 in a uniform layer of toner on PIP 12, developing the latent electrostatic image into a toner image. The toner image is transferred from PIP 12 to an intermediate transfer member (ITM) 20 and then from intermediate transfer member 20 to print medium 22 as medium 22 passes through a nip 23 between intermediate transfer member 20 and a pressure roller 24. Print medium 22 represents generally any suitable print medium and may be delivered to print engine 10 as a continuous web dispensed from a roll or as individual sheets. Pressure roller 24 is commonly referred to as an impression cylinder (IMP). An LED lamp or other suitable discharging device 26 removes residual charge from PIP 12 and toner residue is removed at a cleaning station 28 in preparation for developing the next image or for applying the next toner color plane. Components 12-28 of print engine 10 are conventional components whose structure and operation is well known to those skilled in the art of LEP printing.

Figure 2:
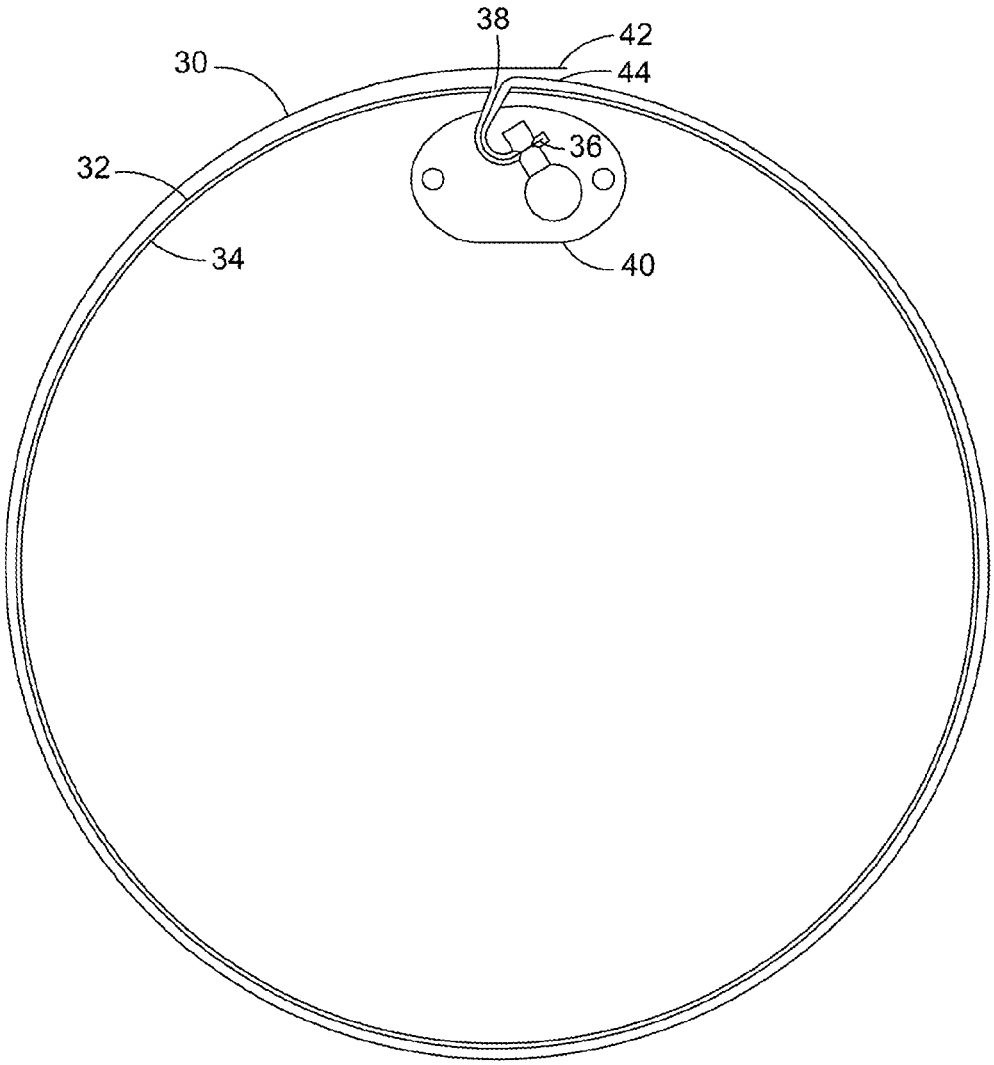
FIG. 2 is an elevation view illustrating a PIP foil wrapped around a PIP drum.

As shown in FIG. 2, PIP 12 typically will include a replaceable photoconductive film 30 wrapped around the outer surface 32 of a cylindrical drum 34. Photoconductive film 30 is commonly referred to as a PIP foil and drum 34 as the PIP drum. The leading edge 36 of PIP foil 30 extends through a slot 38 in drum 34 and is held in a holder 40. The trailing edge 42 of PIP foil 30 overlaps a leading part 44 of PIP foil 30. A thin film of print oil (not shown) acts as an adhesive to hold PIP foil 30 to drum surface 32. During installation of a PIP foil 30, a technician slides leading edge 42 through slot 38 into an open holder 40, closes holder 40 to secure leading edge 42 and then turns PIP drum 34 to wrap PIP foil 30 around outer surface 32 of drum 34.

Figure 9:
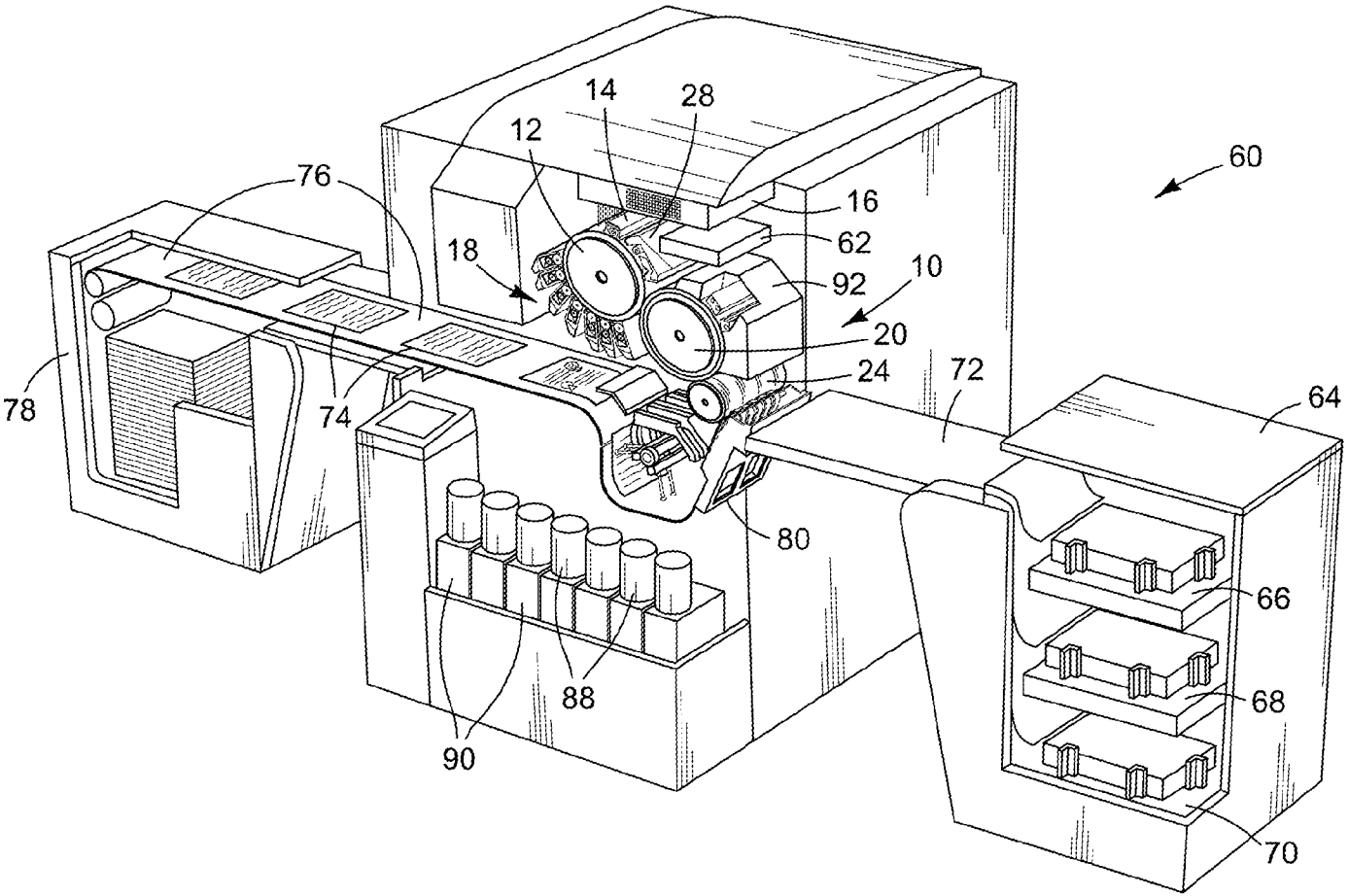
FIG. 9 is a perspective view illustrating an LEP printer constructed according to one embodiment of the disclosure.
Figure 10:
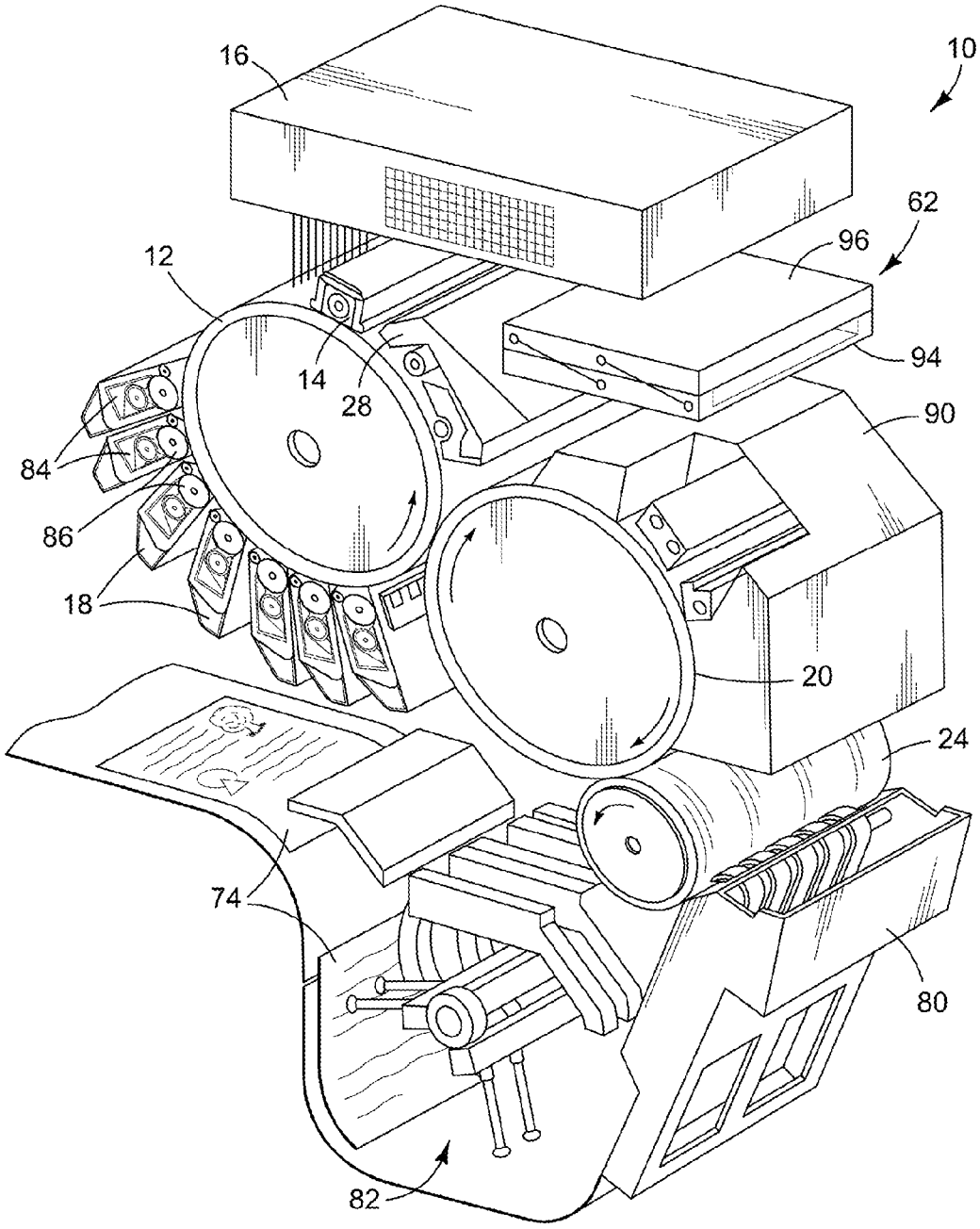
FIG. 10 is perspective view illustrating in more detail the print engine in the printer shown in FIG. 9.

Conventionally, the technician aligns PIP foil 30 to slot 38 and inserts leading edge 36 into holder 40 visually, without the benefit of a mechanical alignment guide, using only the alignment lines on PIP foil 30. The PIP foil is very thin, approximately 100 microns. The technician has limited access to slot 38 and holder 40 within the printing press and there is often only low lighting at the installation area. Under these circumstances the technician must consistently exercise great care to achieve a proper installation. A guide has been developed to facilitate PIP foil installation and to reduce the risk of misalignment. FIGS. 3-8 illustrate the structure and operation of a more general embodiment of a new installation guide. FIGS. 9-10 show the location of a PIP foil installation guide in an LEP printing press. FIGS. 11-18 illustrate the structure and operation of a more specific embodiment of a new installation guide.

Figure 3:
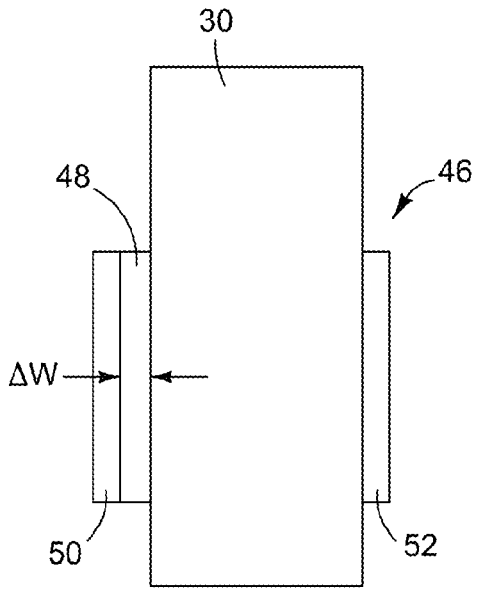
FIGS. 3-5 are plan and elevation views illustrating generally a PIP foil installation guide according to one embodiment of the disclosure.
Figure 4:
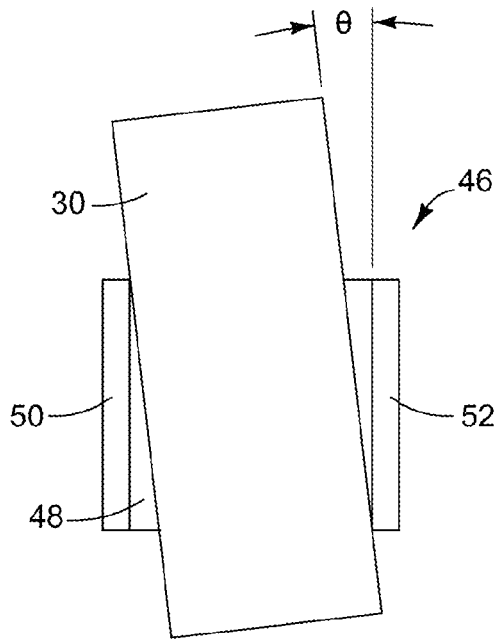
Figure 5:
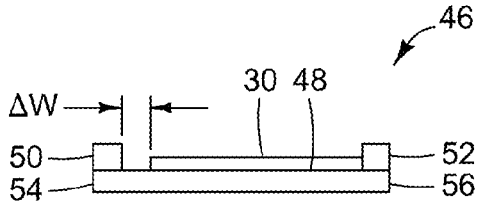

Referring now to FIGS. 3-5, a PIP foil 30 is shown in a channel shaped installation guide 46. Guide 46 includes a bed 48 bordered on two sides by a pair of sidewalls 50, 52. Sidewalls 50 and 52 extend parallel to one another along opposite sides 54, 56 of bed 48 such that the lateral movement of a PIP foil 30 lying on bed 48 is constrained by sidewalls 50, 52. FIGS. 3 and 4 are plan and end elevation views, respectively, showing a PIP foil 30 lying on bed 48 laterally offset to the right against sidewall 52. FIG. 4 is a plan view showing a PIP foil 30 lying on bed 48 skewed between sidewalls 50 and 52. Although it would be desirable to make the width of bed 48 very closely match the width of PIP foil 30 to prevent any lateral or skew misalignment, in practice the actual width of bed 48 must be made significantly greater than the nominal width of PIP foil 30 to account for tolerances in the width of both parts.

For example, a typical PIP foil 30 nominally 353 mm wide may have a total width tolerance of ±0.5 mm (i.e., each PIP foil 30 is 353±0.5 mm wide). In such case, bed 48 must be at least 0.5 mm wider than the nominal width of PIP foil 30 to accommodate any such PIP foil 30 (i.e., bed 48 is at least 353.5 mm wide). In addition, the width of bed 48 may be varied according to its length. A longer bed 48 may allow for a wider bed 48 and a greater width difference, $\Delta W$, and still provide an acceptable degree of alignment. The length of bed 48, however, may (and likely will) be constrained by its physical location in the printer. In the above example of a 353±0.5 mm wide PIP foil 30 that is approximately 1,160 mm long, it has been observed that a nominal width difference $\Delta W$ in the range of 0.6 mm to 1.1 mm for a bed 48 that is 300 mm long will provide an acceptable degree of lateral and skew alignment. Other configurations are possible. In general, increasing the aspect ratio (length of sidewalls/$\Delta W$) of bed 48 will improve alignment. In the above example for PIP foil 30 and bed 48, the width of guide bed 48 should constrain PIP foil 30 to a lateral offset not greater than about 1.1 mm ($\Delta W \leq 1.1$ mm) and the aspect ratio (length of sidewalls/$\Delta W$) of bed 48 should prevent skew greater than about 0.2° ($\theta \leq 0.2°$).

Figure 6:
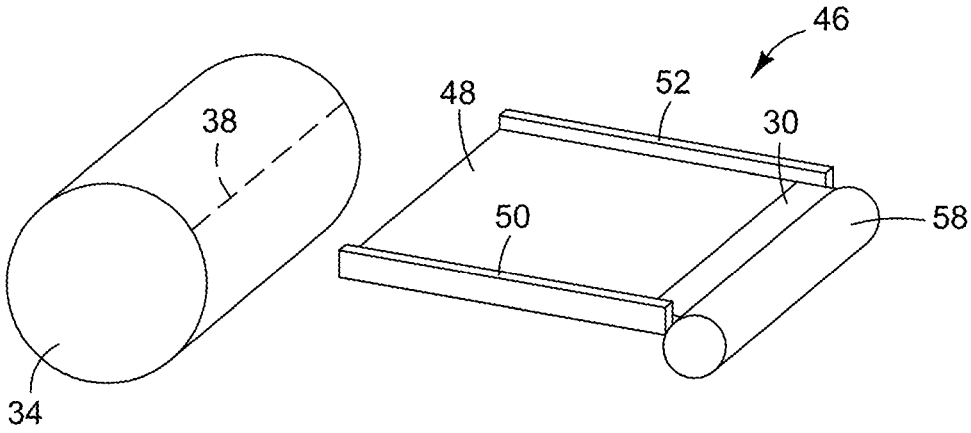
FIGS. 6-8 illustrate aligning a PIP foil to a PIP drum using the installation guide shown in FIGS. 3-5.
Figure 7:
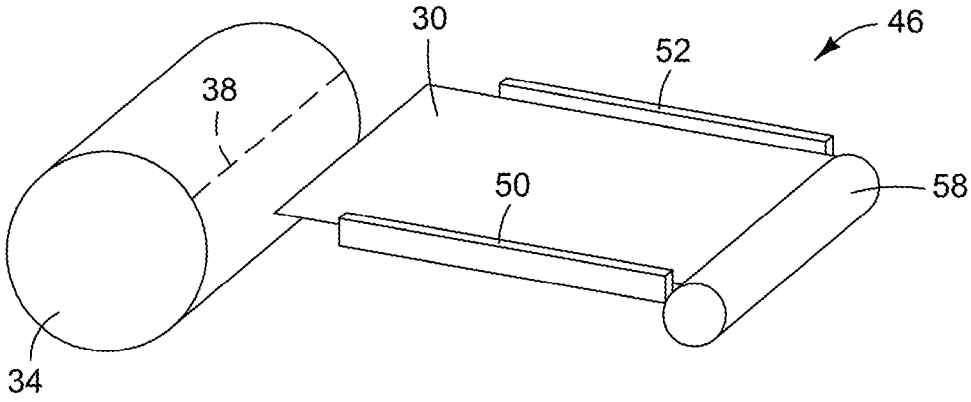
Figure 8:
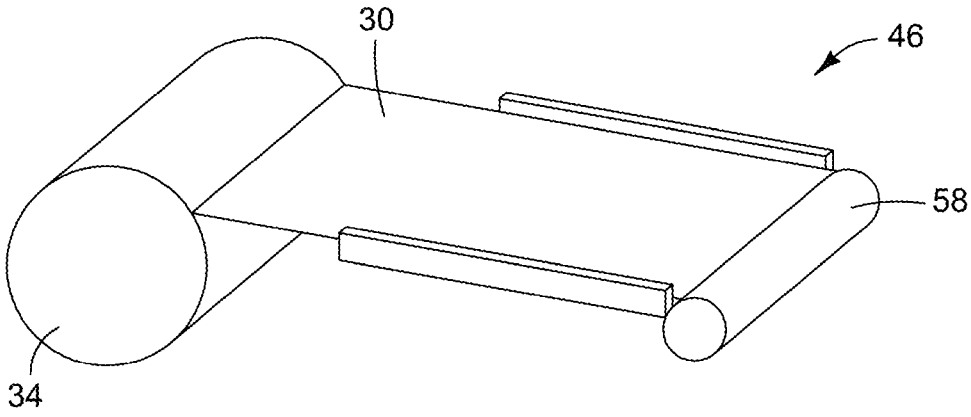

A sequence for installing a PIP foil 30 using guide 46 is illustrated in FIGS. 6-8. Referring to FIGS. 6-8, a new PIP foil 30 is contained in a capsule 58. A technician pulls the new PIP foil 30 out of capsule 58 and pushes foil 30 flat along guide bed 48 until foil 30 reaches PIP drum 34 and into holder 40 (not shown) through slot 38 where it may be secured for wrapping around drum 34.

FIG. 9 illustrates one embodiment of an LEP printer 60 implementing a print engine 10 with a PIP foil installation guide 62. FIG. 10 is a more detailed view of print engine 10. Referring to FIGS. 9 and 10, printer 60 includes a media feed unit 64 with multiple media input trays 66, 68, and 70. Sheets of a print medium are fed from stacks 66, 68, and 70 across a feed bridge 72 to print engine 10 from which they emerge as printed sheets 74 conveyed along a discharge path 76 to an output stacker 78. Although not shown, various operations may be performed along discharge path 76 including, for example, ILD (in-line densitometer) color calibration and adjustment and sheet routing to a proof tray. Printed sheets 74 may be routed back through print engine 10 via a duplex conveyor 80 at the urging of a so-called exit guide perfector 82 configured to selectively move sheets 74 out to discharge path 76 or back through duplex conveyor 80.

Print engine 10 includes a scorotron charging device 14 located adjacent to a PIP 12 for applying a uniform electric charge to PIP 12. As described above with respect to FIG. 2, PIP 12 includes a replaceable PIP foil wrapped around the outer surface of a cylindrical PIP drum. The PIP foil and PIP drum are not depicted or called out separately in FIGS. 9 and 10. A photo imaging device 16 exposes selected areas on PIP 12 to light in the pattern of the desired printed image. A thin layer of liquid toner is applied to the patterned PIP 12 through one or more of a series of developer units 18 to develop the latent image on PIP 12 into a toner image. Each developer unit 18 moves ink from an internal reservoir 84 to a developer roller 86 that rotates against PIP 12. Each developer unit 18 usually applies a different color ink from a corresponding series of toner supply cans 88. The toner held in each supply can 88 is typically about 20% solids, having the consistency of toothpaste. The paste-like toner is diluted to about 2% solids in dilution tanks 90 before it is pumped to a developer unit 18 and applied to PIP 12.

The toner image is transferred from PIP 12 to the outside surface of an intermediate transfer member 20. The toner image is then transferred and fused to the print medium as the print medium passes through the nip between intermediate transfer member 20 and a pressure roller 24. An LED lamp or other suitable discharging device 26 removes residual charge from PIP 12. Toner residue is removed at a cleaning station 28 in preparation for developing the next image or applying the next toner color plane. Volatile fumes generated as the toner carrier fluid evaporates off intermediate transfer member 20 are evacuated through a suction hood 92. PIP foil installation guide 62 is located within print engine 10 adjacent to cleaning station 28. Cleaning station 28 is a modular unit that may be removed for maintenance or replacement and for providing access to PIP 12. As described in detail below with reference to FIGS. 11-18, guide 62 includes a movable bed assembly 94 and a stationary base 96. Bed assembly 94 is movable from a closed, stowed position shown in FIGS. 9 and 10 and, upon the removal of cleaning station 28, to an open position in which assembly 94 swings down to PIP 12.

Figure 11:
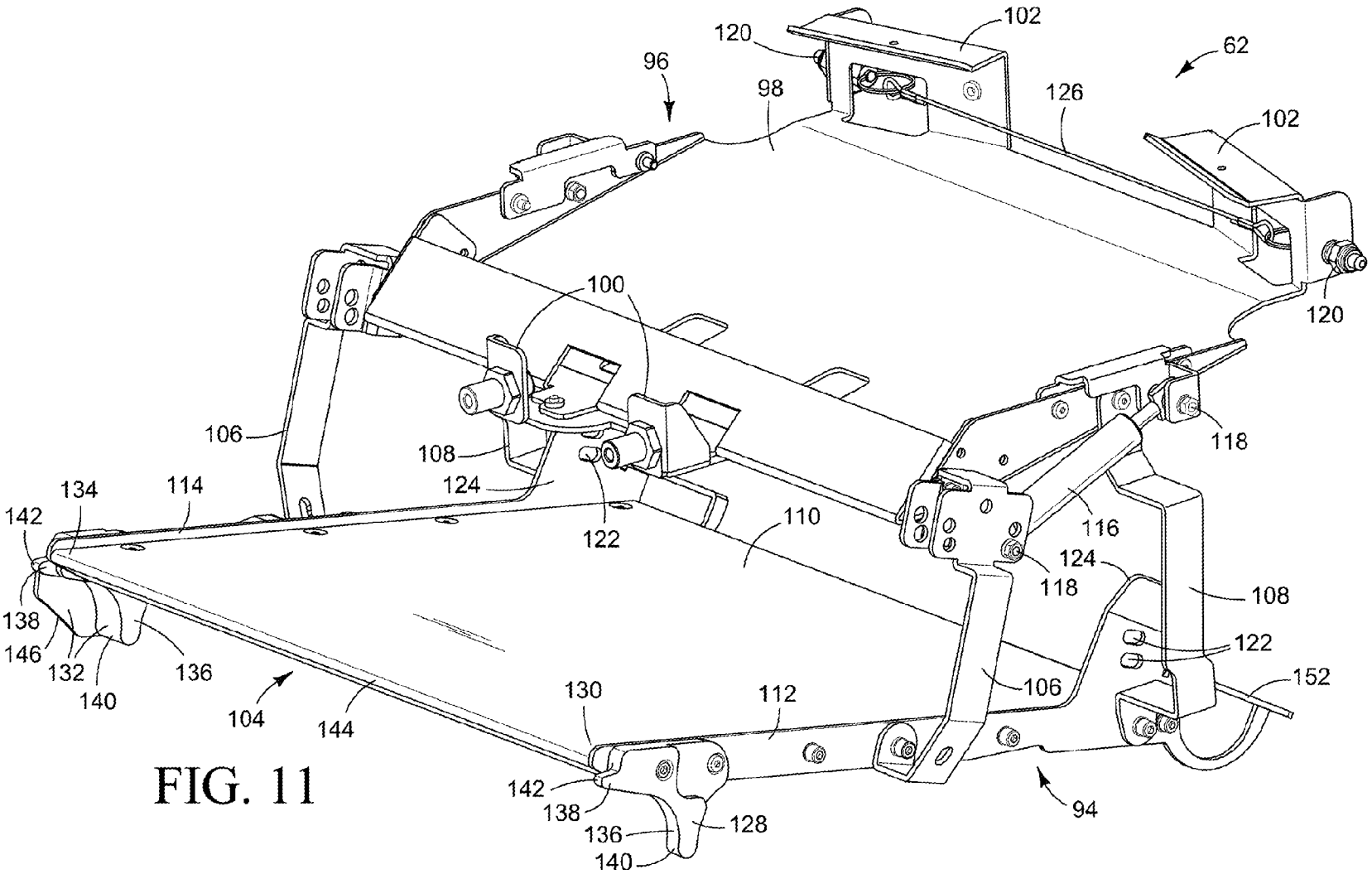
FIG. 11 is a perspective view and FIGS. 12 and 13 are elevation views illustrating more specifically a PIP foil installation guide according to one embodiment of the disclosure.
Figure 12:
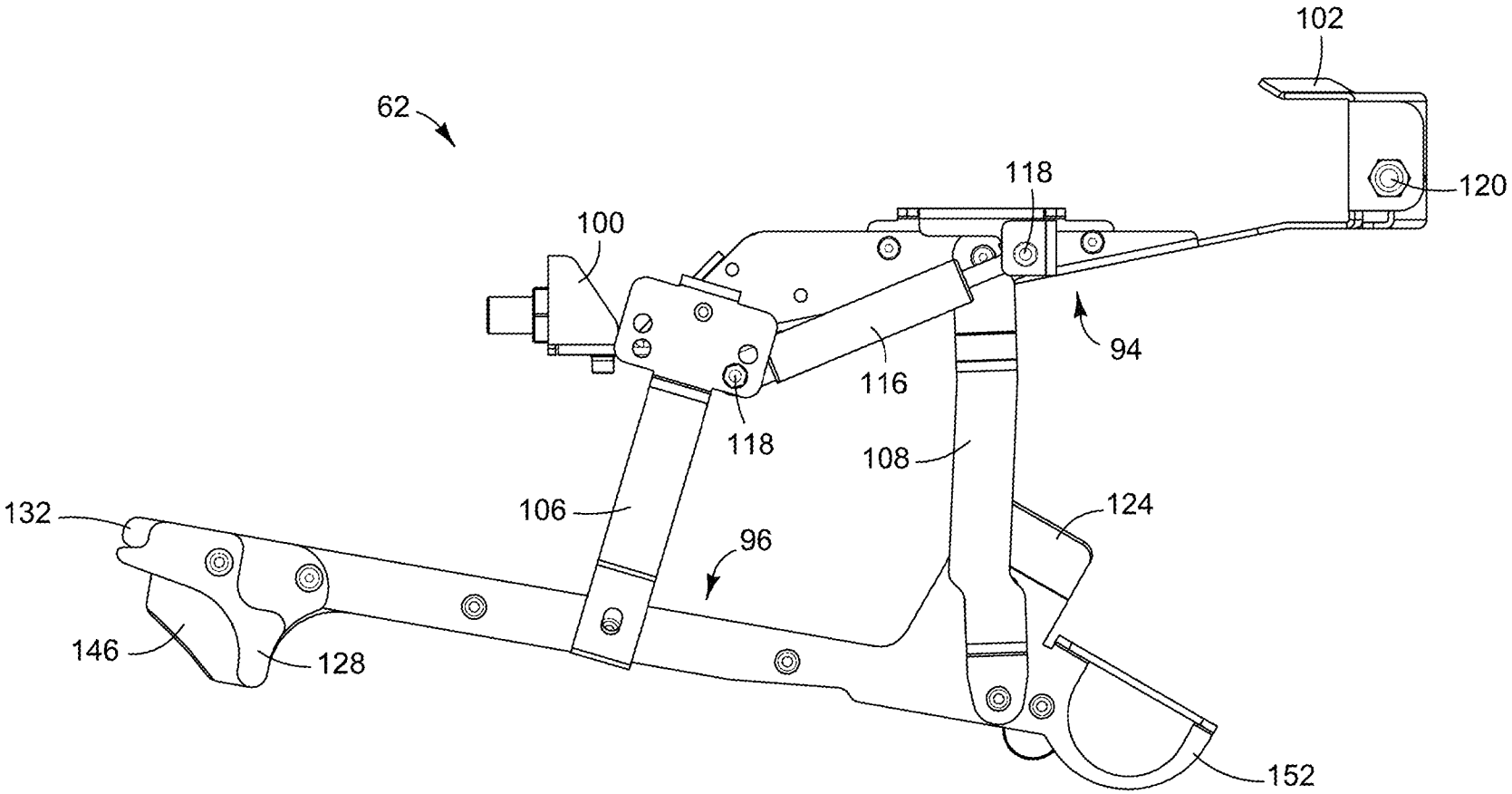
Figure 13:
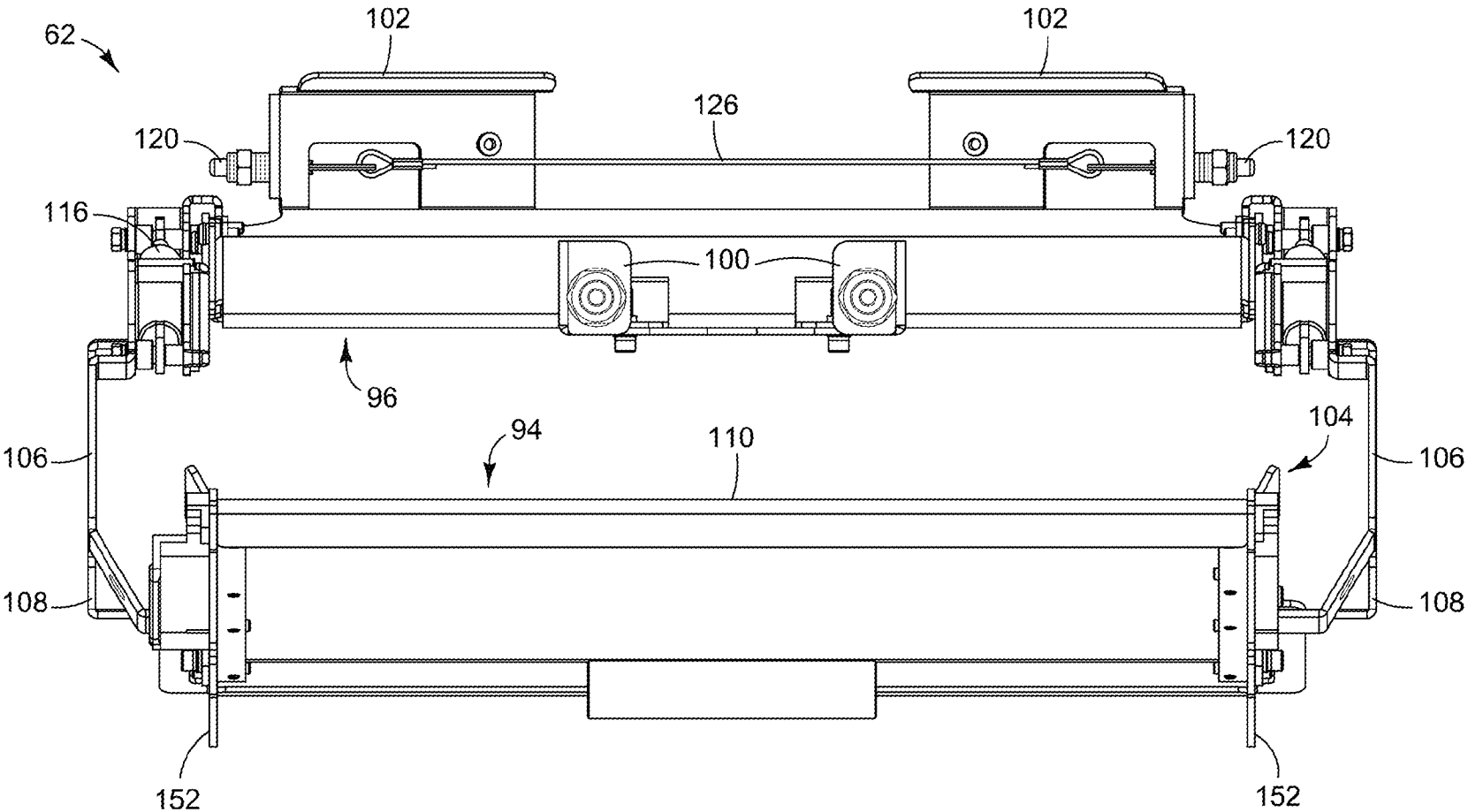
Figure 14:
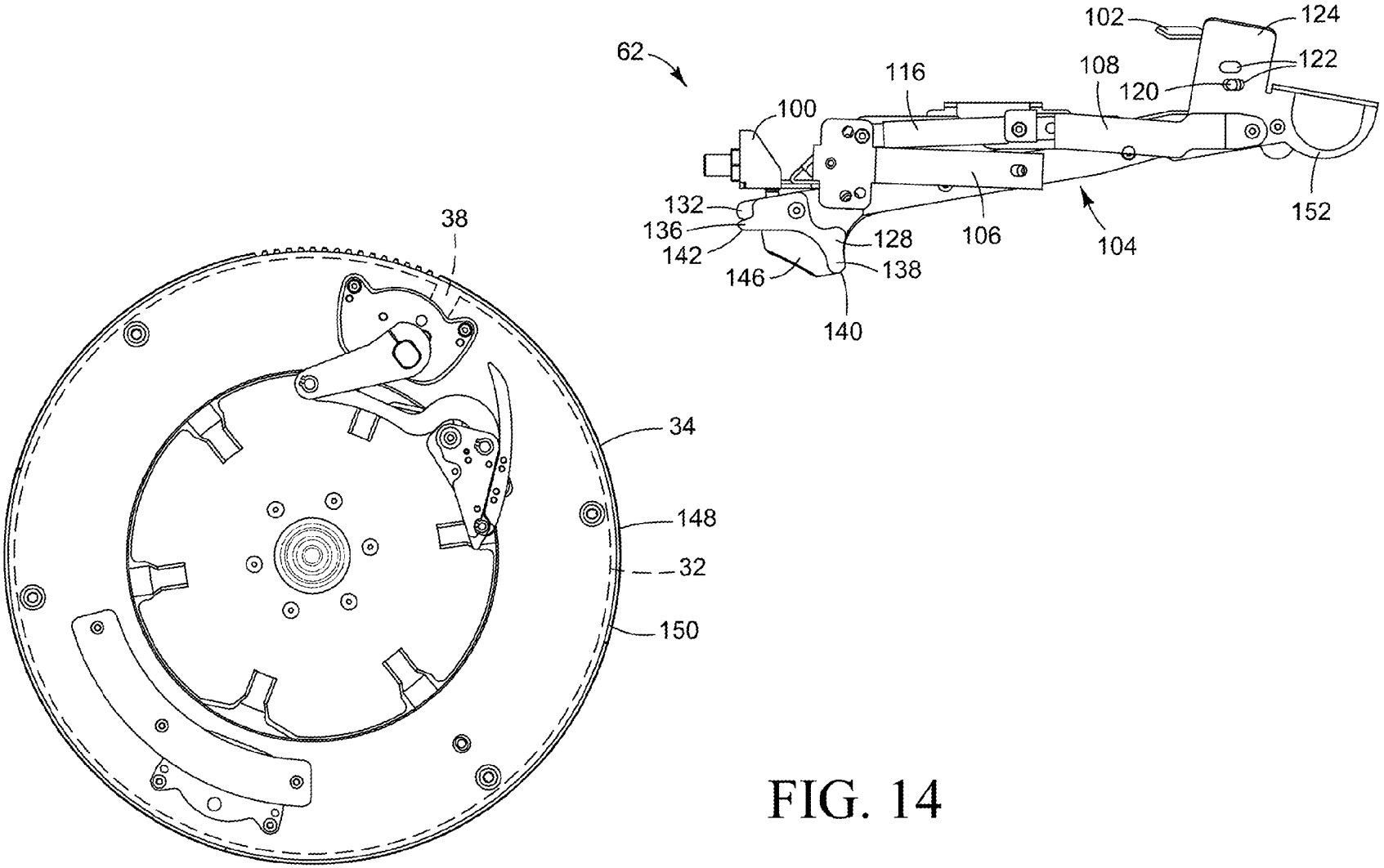
FIGS. 14-16 are elevation views and FIG. 17 is a perspective view illustrating the operation of the installation guide shown in FIGS. 11-13.
Figure 15:
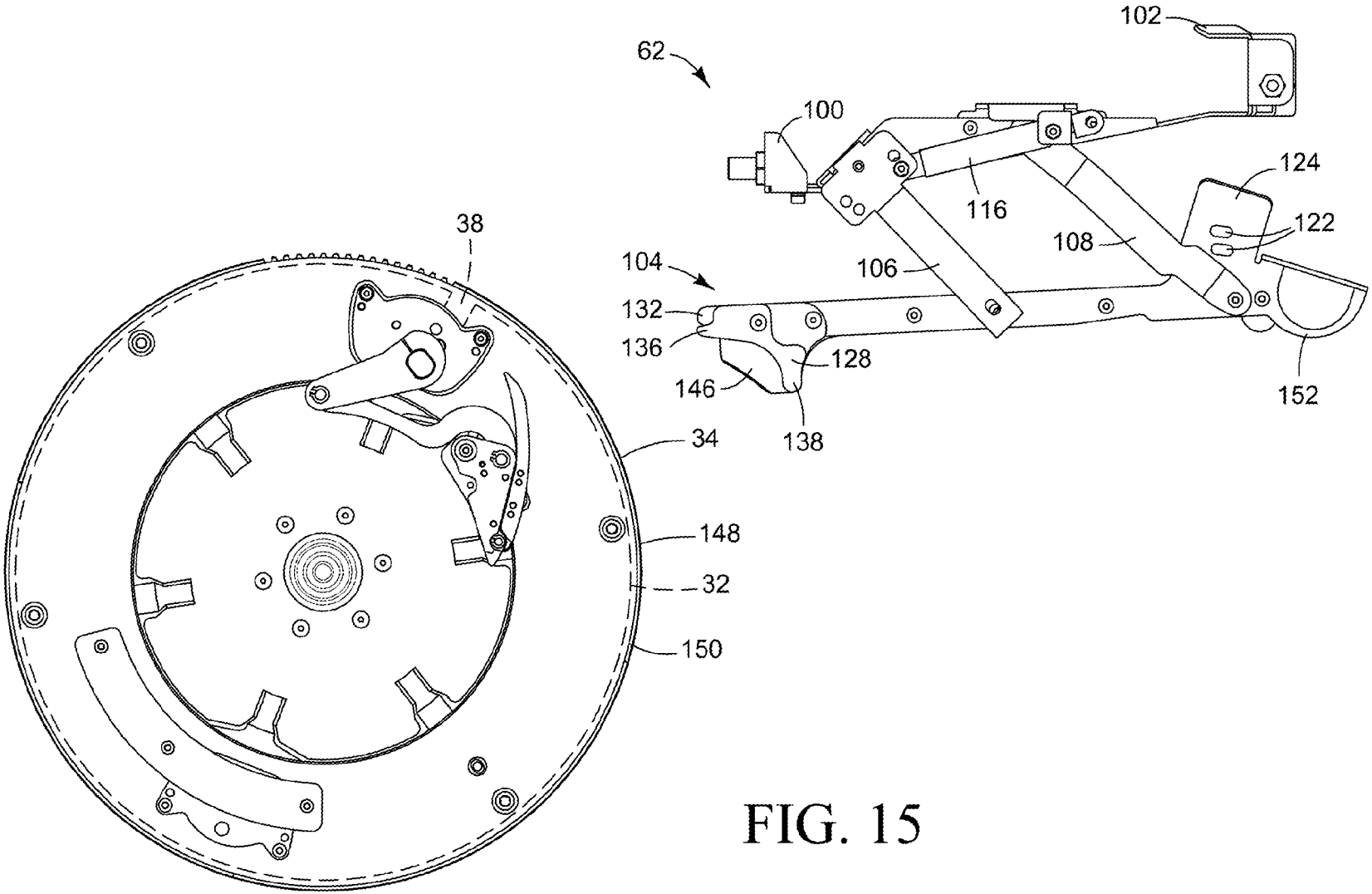
Figure 16:
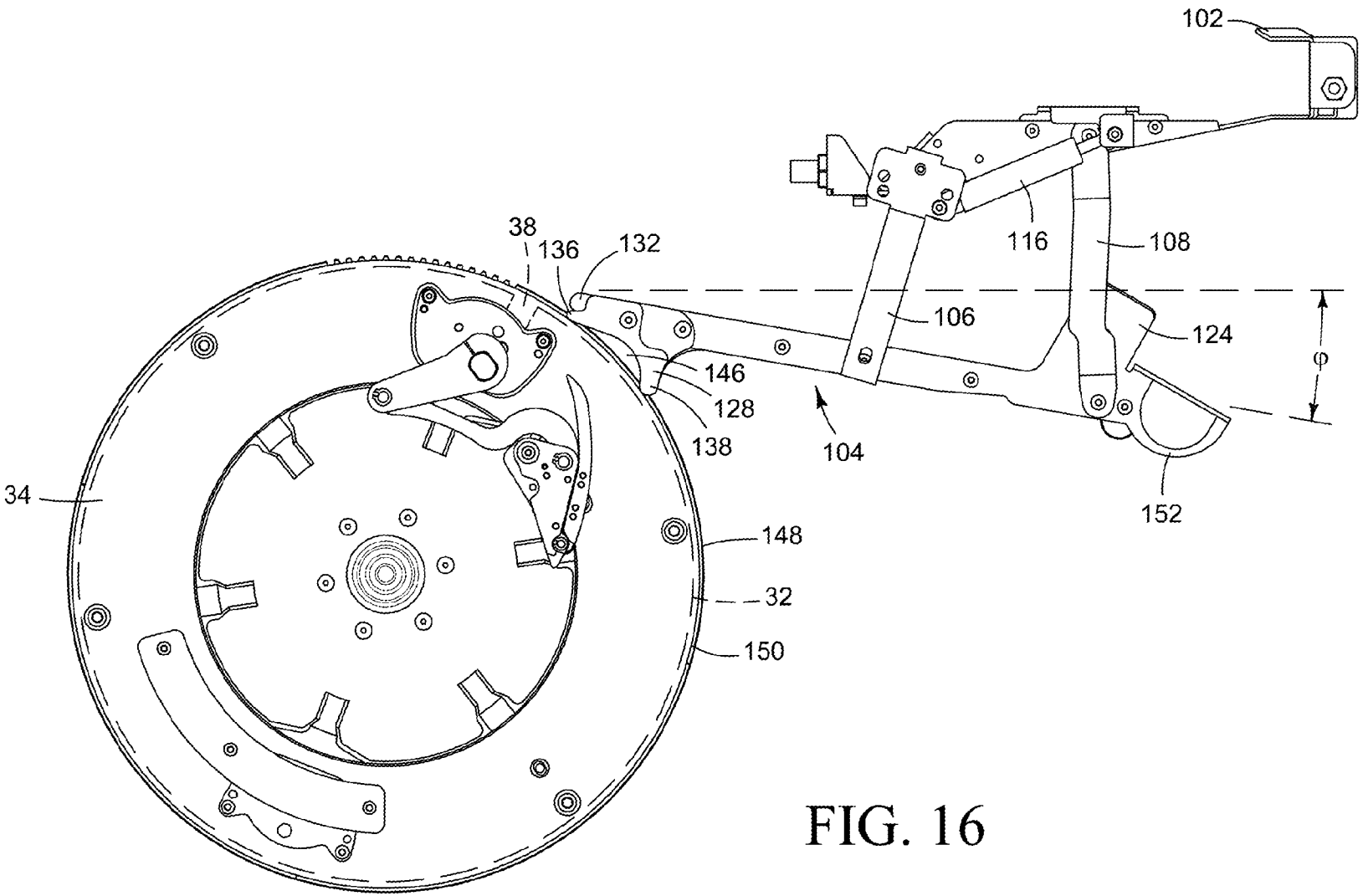
Figure 17:
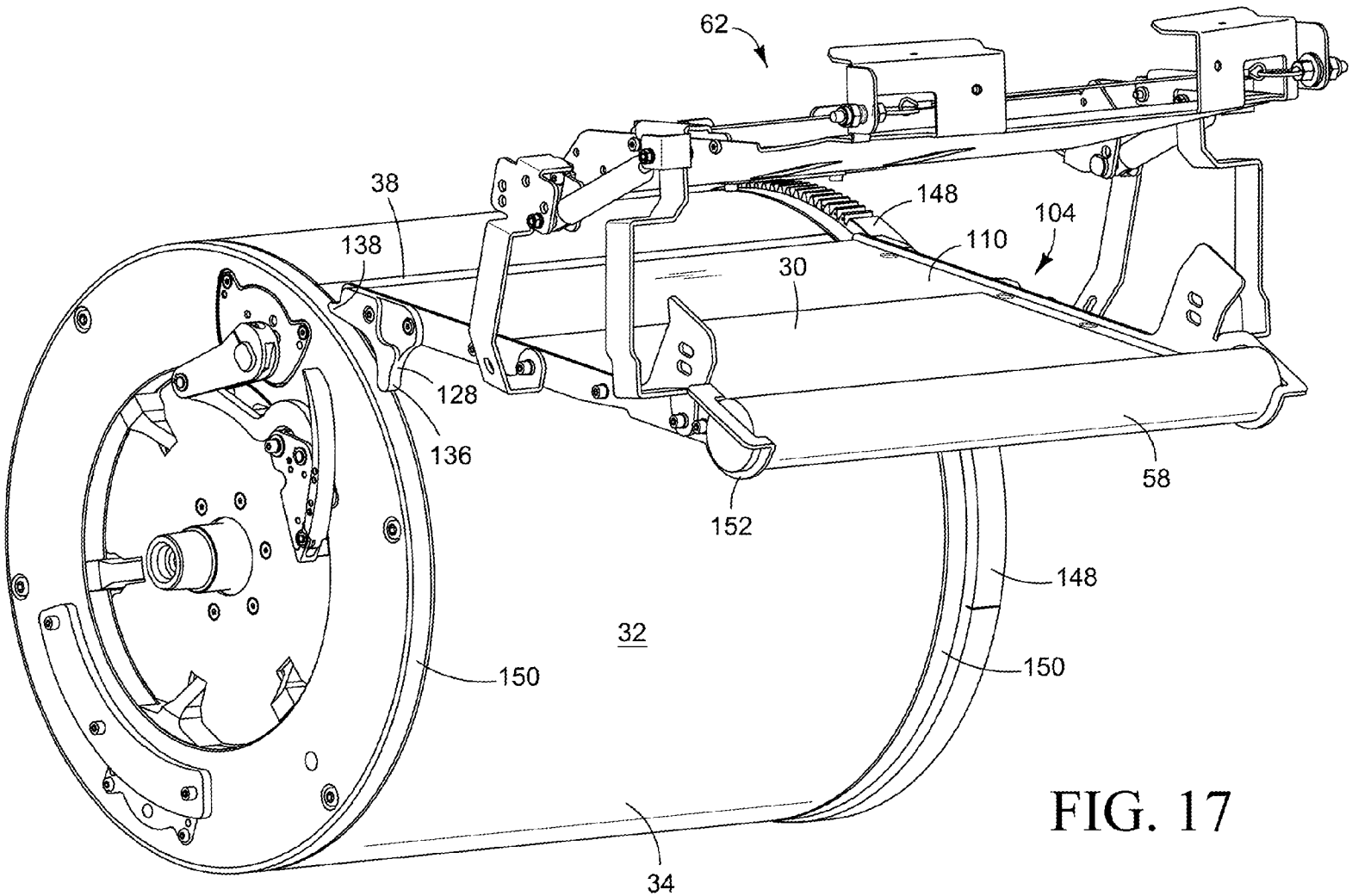

FIG. 11 is a perspective view and FIGS. 12 and 13 are elevation views illustrating more specifically a PIP foil installation guide 62 according to one embodiment of the disclosure. FIGS. 11-13 show guide 62 in the open, operative position. FIGS. 14-16 are elevation views and FIG. 17 is a perspective view illustrating the operation of installation guide 62 between the closed, stowed position and the open position. Referring first to FIGS. 11-17, guide 62 includes movable base assembly 94 and stationary base 96. In the embodiment shown, for example, base 96 is specially adapted for retrofit mounting in HP Indigo® LEP digital printing presses at a location shown in FIGS. 9 and 10. In this embodiment, base 96 includes a generally flat plate 98 secured into the desired position against a mating surface on the press (not shown) using, for example, angle brackets 100 at the front and flanges 102 at the rear.

Movable bed assembly 94 includes a guide channel 104 attached to base 96 with a pair of forward hinges 106 and a pair of rearward hinges 108. Channel 104 is defined by a bed 110 bordered on two sides by sidewalls 112 and 114. Bed assembly 94 also includes a pair of gas springs 116 or another suitable "two-way" biasing mechanism. Each gas spring 116 is operatively coupled between base 96 and a forward hinge 106 at pivots 118 such that springs 116 urge bed assembly 94 toward the closed position shown in FIG. 14 when bed assembly 94 is in or near the closed position and toward the open position shown in FIGS. 16 and 17 when bed assembly 94 is in or near the open position. Bed assembly 94 may be locked into the closed position, for example, with a pair of retractable, spring loaded pins 120 that fit into corresponding holes 122 in flanges 124 at the rear of channel sidewalls 112 and 114. In the embodiment shown, locking pins 120 are retracted simultaneously by pulling on an actuator cable 26 that extends between pins 120.

A stopper 128 is attached to or integral with the front left corner 130 of channel 104. A stopper 132 is attached to or integral with the front right corner 134 of channel 104. In the embodiment shown, each stopper 128 and 132 is a discrete plastic part attached to the forward part of sidewalls 112 and 114, respectively. Plastic or another suitable softer, non-abrasive material is desirable to avoid scratching PIP drum 34. Each stopper 128 and 132 includes two fingers 136 and 138 protruding forward for contacting PIP drum 34. As best seen in FIGS. 16 and 17, the ends 140 and 142 of fingers 136 and 138 are configured with respect to one another such that, when bed assembly 94 is in position against PIP drum 34, channel bed 110 is rotationally stable at the desired angle relative to drum surface 32, and the forward end 144 of channel 104 is spaced the desired distance from drum surface 32 and slot 38.

The use of two stoppers 128 and 132 spaced apart from one another axially along the cylindrical PIP drum 34 aligns channel forward end 144 parallel to a line extending along drum surface 32 (i.e., the plane of each sidewall 112, 114 intersects the drum cylinder at a right angle). The configuration of stopper fingers 136 and 138 may be changed as necessary or desirable to achieve the desired position of bed 110 relative to PIP drum 34 by, for example, adjusting the length of each finger 136 and 138 and changing the spacing or offset/incline between finger ends 140 and 142.

Figure 18:
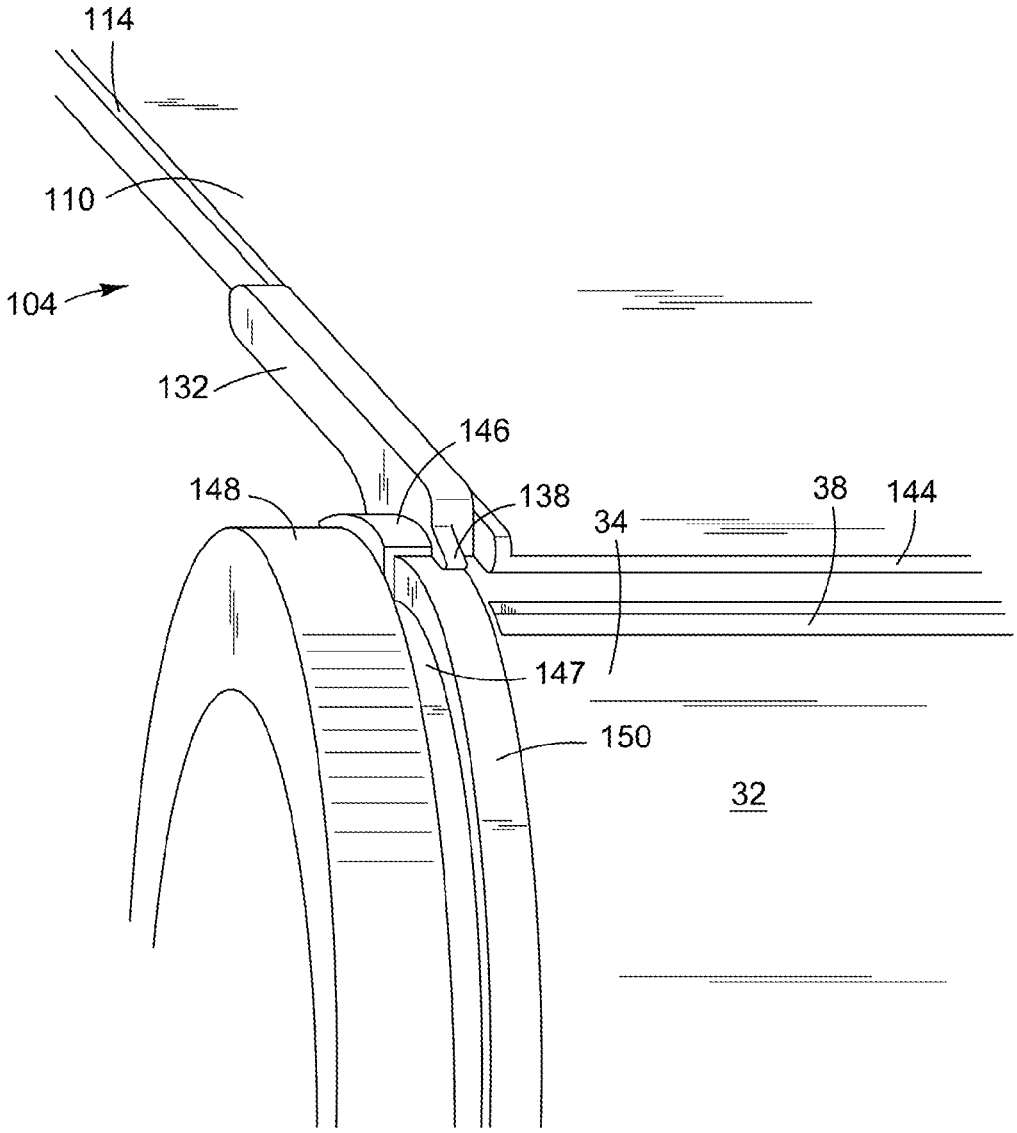
FIG. 18 is a detail view of a portion of the guide channel shown in FIGS. 14-16.

As best seen in the close-up view of FIG. 18, right side stopper 132 includes a spacer 146 outboard from fingers 136, 138. Spacer 146 fits into a gap 147 between an outboard ring gear 148 and a bearing surface 150 on PIP drum 34 to properly position channel 104 relative to PIP drum 34 in the lateral direction, axially along the drum cylinder.

The procedure for replacing a PIP foil 30 on PIP drum 34 will now be described with reference to FIGS. 14-18. As with a conventional PIP foil replacement procedure, the press operator or other technician removes cleaning station module 28 (shown in FIGS. 9 and 10) and locks PIP drum 34 with slot 38 in about the 1 o'clock position as shown in FIG. 16. The technician pulls actuator cable 126 to retract locking pins 120 and release movable bed assembly 94 from the stowed position shown in FIG. 14. Channel 104 may then be pushed down and forward through an intermediate position, shown in FIG. 15, into the fully open, operative position immediately adjacent to drum surface 32 and slot 38, as shown in FIGS. 16 and 17. Channel 104 may be moved to the open position, for example, by the technician placing her hand on bed 110 and pressing down and forward. Stoppers 128 and 132 are held against PIP drum 34 at the urging of gas springs 116. Hinges 106 and 108 may be made from sheet metal or another suitable spring material if necessary or desirable to allow the technician to move channel 104 laterally along drum 34 a small amount to fit spacer 146 on right stopper 132 into the gap 147 between ring 148 and bearing surface 150.

Once movable bed assembly 94 is in the fully open position against drum 34 as shown in FIGS. 16 and 17, the technician may then install a new PIP foil capsule 58 in holder 150 and withdraw a new PIP foil 30 from capsule 58, as shown in FIG. 17. The technician holds PIP foil 30 flat against bed 110 as she slides PIP foil 30 forward along bed 110, into slot 38 and holder 40 (holder 40 is shown in FIG. 2). After closing holder 40 to secure PIP foil leading edge 36, the technician releases and turns PIP drum 34 to wrap the new foil 30 around drum surface 32 as described above with reference to FIG. 2. PIP foil 30 typically retains some curl as it is unrolled out of capsule 58. Hence, it may be desirable to incline bed 110 at an angle $\phi$ up to about 30°, as best seen in FIG. 16, to allow PIP foil leading edge 36 to curl naturally off bed 110 into slot 38 where the forward end 144 of channel 104 is positioned 2 mm to 10 mm from slot 38.

The example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A guide for installing a photoconductive film on to a photo imaging plate comprising a cylindrical photo imaging plate, the guide comprising:

a movable channel near the photo imaging plate, the channel having a bed and a pair of sidewalls extending parallel to one another along opposite sides of the bed such that lateral movement and skew of a photoconductive film lying on the bed is constrained by the sidewalls, and the channel movable between a first position in which an open end of the channel is away from the photo imaging plate and a second position in which the open end of the channel is immediately adjacent to and aligned with the photo imaging plate for installing a photoconductive film on to the photo imaging plate; and an alignment feature at a forward part of the channel, the alignment feature configured to align each sidewall in a plane that intersects the cylinder of the photo imaging plate at a right angle when the channel is in the second position.

2. The guide of claim 1, wherein the alignment feature is further configured to stabilize the bed of the channel rotationally with respect to the cylindrical photo imaging plate when the channel is in the second position.

3. A guide for installing a photoconductive film on to a photo imaging plate comprising a cylinder, the guide comprising:

a movable channel near the photo imaging plate, the channel having a bed and a pair of sidewalls extending parallel to one another along opposite sides of the bed such that lateral movement and skew of a photoconductive film lying on the bed is constrained by the sidewalls, and the channel movable between a first position in which an open end of the channel is away from the photo imaging plate and a second position in which the open end of the channel is immediately adjacent to and aligned with the photo imaging plate for installing a photoconductive film on to the photo imaging plate, wherein a line extending laterally across the open end of channel is parallel to a line extending axially along a surface of the cylinder when the channel is in the second position.

4. The guide of claim 3, wherein a forward end of the bed is 2 mm to 10 mm from the surface of the cylinder and the bed inclines up toward the surface of the cylinder at an angle not more than 30° when the channel is in the second position.

* * * * *